US005806709A

United States Patent [19]

Marshall, II

[11] Patent Number: 5,806,709

[45] Date of Patent: Sep. 15, 1998

[54] HANDLE FOR USE WITH PAINT CAN

[76] Inventor: Henry W. Marshall, II, 1076 Kaolin Rd., Kennett Square, Pa. 19348

[21] Appl. No.: 853,556

[22] Filed: May 9, 1997

Related U.S. Application Data

[60] Provisional application No. 60/037,705, Feb. 12, 1997.

[51] Int. Cl.[6] ..... B65D 25/28

[52] U.S. Cl. ..... 220/755; 220/759; 220/756; 220/914; 294/32

[58] Field of Search ..... 294/27.1, 32, 25, 294/172; 220/759, 755, 756, 760, 914

[56] References Cited

U.S. PATENT DOCUMENTS

| | | | |
|---|---|---|---|
| 2,788,153 | 4/1957 | Broadbelt | 294/27.1 |
| 3,261,633 | 7/1966 | Sakuta | 294/32 |
| 4,993,767 | 2/1991 | Song | 220/755 |
| 5,203,471 | 4/1993 | Widman | 220/759 |
| 5,482,339 | 1/1996 | Chishko, Jr. | 220/759 |
| 5,570,807 | 11/1996 | Busch | 220/760 |
| 5,584,520 | 12/1996 | Niemeier | 220/759 |

*Primary Examiner*—Stephen J. Castellano
*Attorney, Agent, or Firm*—Ratner & Prestia

[57] ABSTRACT

The invention relates to a handle for use with a paint can of the type having a bottom, a bottom rim, a side wall a top and a bail. The handle comprises a base, a slot in the base for receiving the bottom rim, and a side support extending substantially perpendicular from said base adjacent the slot. The side support has an inner surface and an outer surface, with a hook on the outer surface for engaging the bail, whereby when the can is placed on the base and the bail engaged by the hook the handle is securely held against the can bottom and side wall.

11 Claims, 4 Drawing Sheets

HANDLE FOR USE WITH PAINT CAN

This Application claims the benefit of U.S. Provisional Application number 60/037,705, filed Feb. 12, 1997.

BACKGROUND OF THE INVENTION

1. Field of the Invention

The invention relates to a handle accessory for a can. More particularly, the invention relates to a handle for a paint can which is adapted to hook the bail of the paint can while, at the same time, engaging the bottom of the can.

2. Description of the Invention

Nearly every paint can sold to the general public today comprises a cylindrical paint bucket having a swingably attached wire-thin handle, known in the art as the "bail." The bail is generally attached at diametrically opposed points on the outside of the can. Such wire-thin bails are uncomfortable.

Due to the swinging attachment of the bail, it is quite difficult to hold the paint can from the bail in a stable fashion. This is a serious problem for painters who paint directly from the can. For example, as one is standing on a ladder and painting with one hand while holding the paint can with the other, one often finds that the paint can swings to and fro uncontrollably, such that paint may spill all over.

The attachment of the bail also presents a problem in that when the painter holds the paint can from the bail, the paint can hangs straight down from the painter's hand such that the painter's hand blocks accessibility to much of the can opening. This positioning makes it quite difficult to both hold the can and dip the paintbrush into the paint without smearing paint on the hand holding the paint can. This can be bothersome to the user and the extra care which must be expended to avoid smearing becomes tedious and time consuming.

Handle accessories have been developed in order to avoid some of the aforementioned problems. Generally such handle accessories are adapted to work with the bail of the can by holding the bail in an off-set position over the top of the can. Although such embodiments improve the comfort of holding the can from the bail as well as provide a larger opening for access to the interior of the can, much of the can opening is still obstructed by the handle accessory.

In order to avoid this problem completely, some painters merely place their fingers under the bottom of the can while grasping the bail with their thumb. In this case, the bail is lying off to the side of the can, not over the top, and the entire opening of the can is accessible. Although holding the can in such a fashion does leave the entire top of the can accessible, there is a significant increase in discomfort, especially to the thumb as it bears a significant amount of the weight of the can. In order to ease some of this discomfort, painters are forced to hold the paint can in such a fashion for limited periods at a time.

An additional problem with holding the can as just described is that it is very precarious and awkward. The thumb will eventually tire, and as a result, the likelihood that the bail will slip from the thumb, and spill, increases substantially.

Accordingly, there is a need for a paint can holder which allows full access to the open top of the paint can while also providing comfort and reducing fatigue on the hand of the user.

SUMMARY OF THE INVENTION

The invention relates to a detachable handle for use with a paint can having a bottom, a bottom rim, a side wall and a bail, the detachable handle comprising:

a base;

a side support extending substantially perpendicular from the base, the side support having an inner surface and an outer surface;

a rim engaging groove on the base adjacent the support;

a bail engaging hook mounted on the outer surface of the side support; and a hand abutment extending away from said base and said support.

The handle is adapted to hook the bail of the paint can while, at the same time, engaging the bottom of the can.

DESCRIPTION OF THE PREFERRED EMBODIMENT(S)

Many painters prefer to paint directly from the paint can and hold the can by locking their thumb around the bail and placing their fingers under the bottom of the can.

The present device was created because the manner of holding a paint can as just described is uncomfortable and precarious. Accordingly, a device that can attach to a paint can to allow a painter to hold the can as described above, but in a more comfortable manner, would substantially improve a painter's job. The present invention does just that.

Figure 1:
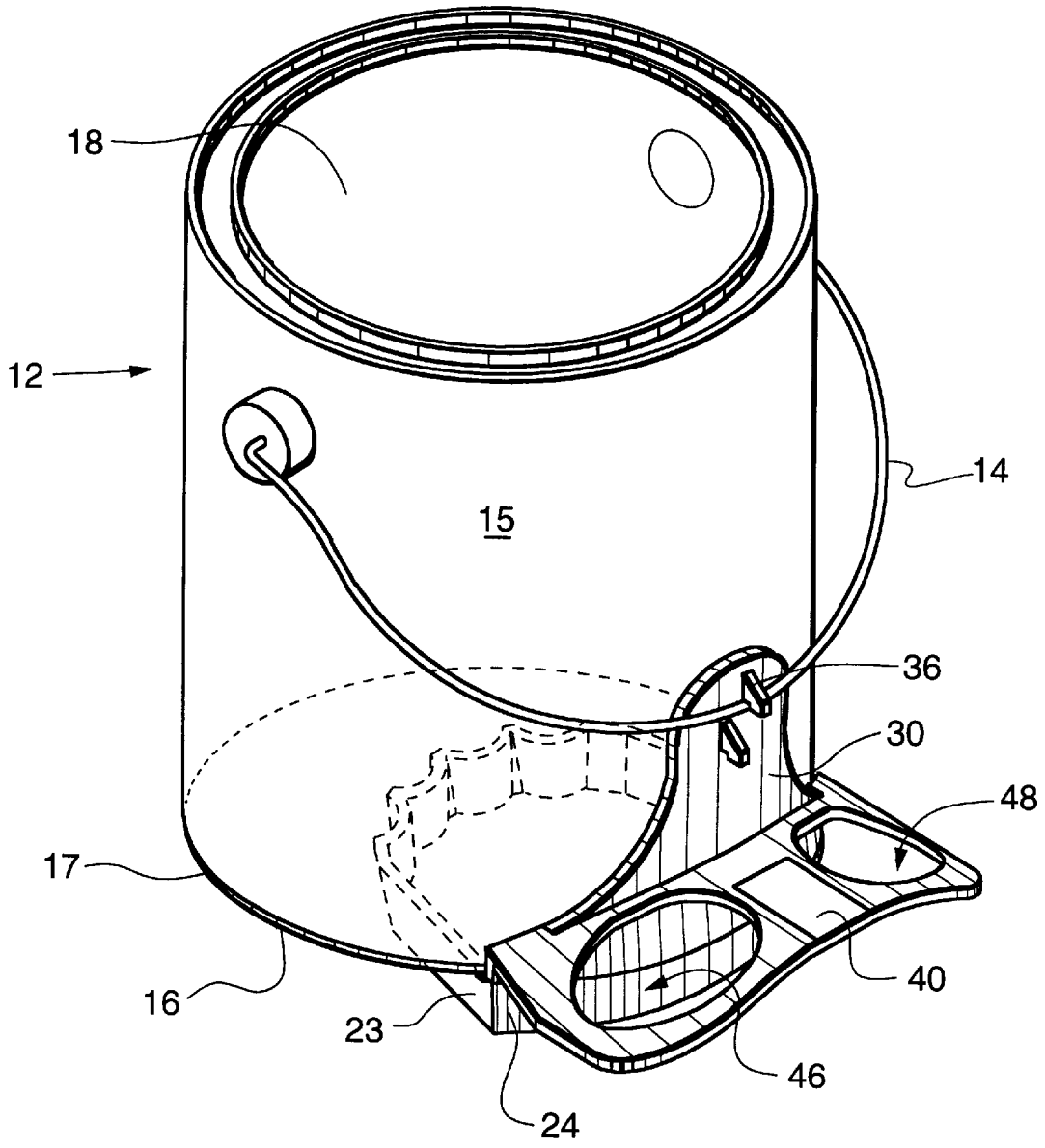
FIG. 1 is a perspective representation of a handle in accordance with the present invention mounted on a paint can.

As shown in FIG. 1, the present device 10 is adapted to work with a paint can 12 having a bail 14, a side wall 15, a bottom 16, a bottom rim 17 and a top 18. The device can be designed to fit a particular sized can 12.

Figure 3:
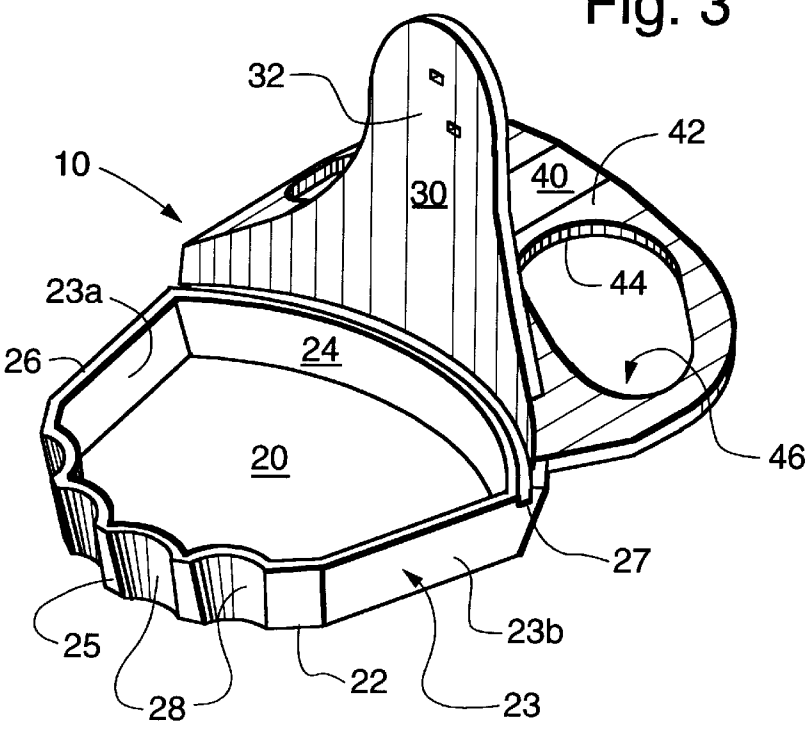
FIG. 3 is a second perspective representation of a handle in accordance with the present invention.
Figure 2:
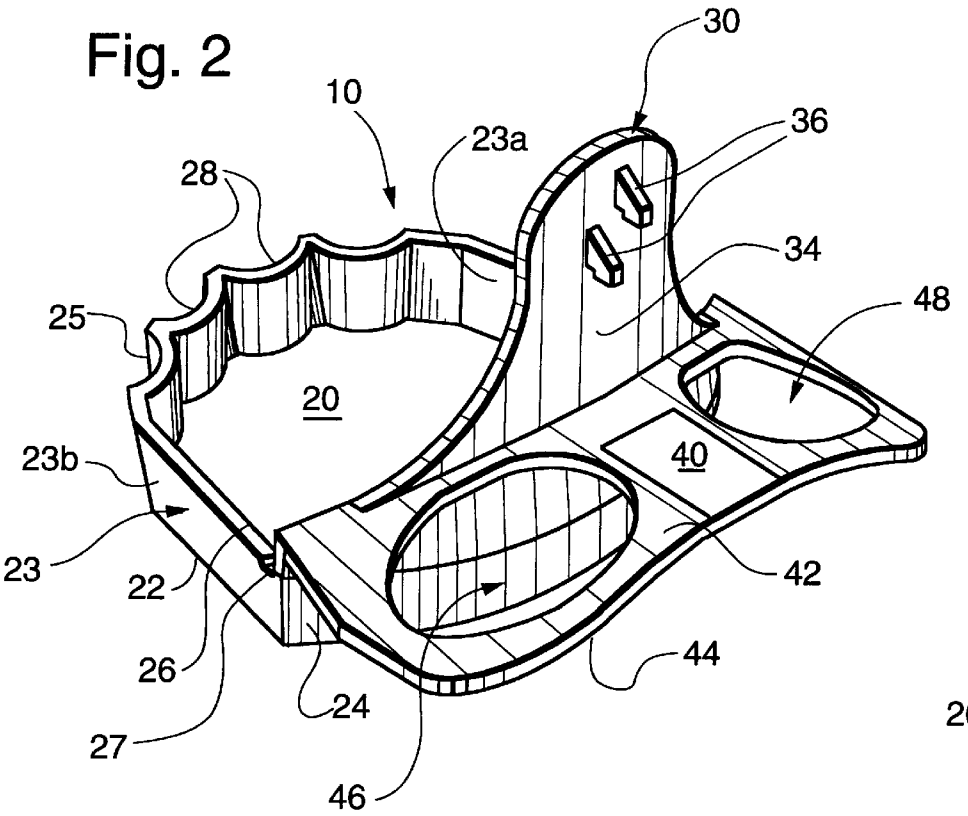
FIG. 2 is a first perspective representation of a handle in accordance with the present invention.

Referring now particularly to FIGS. 2 & 3, the device 10 comprises a base 20 having a rim engaging groove 27 for receiving the bottom rim 17 of the paint can 12 and a side support 30 having thereon at least one hook 36 to engage the bail 14 of the can 12.

The base 20 comprises a bottom 22 and a perimeter wall 23. The perimeter wall 23 is preferably formed along the entire perimeter of the base 20, and extends upwards substantially perpendicular from the plane of the bottom 22 of base 20. The perimeter wall 23 has a front portion 24, a back portion 25, an inner surface 23*a*, an outer surface 23*b* and a top surface 26. The front portion 24 is aligned with the side support 30 while the back portion 25 is located opposite the front 24.

Figure 6:
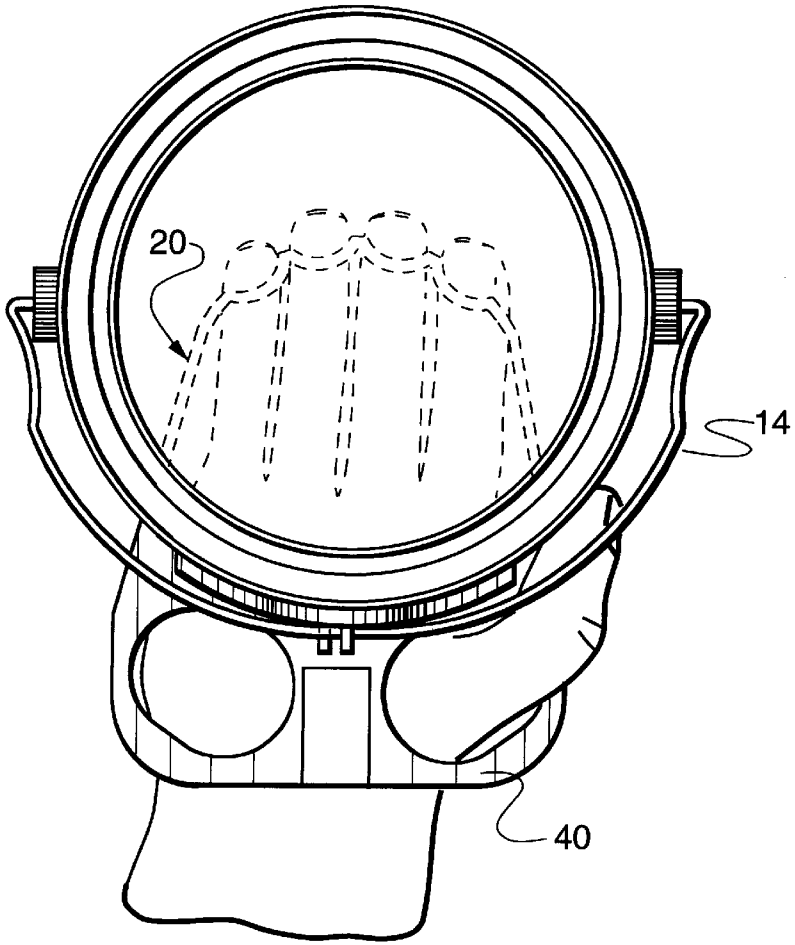
FIG. 6 is a top view of a handle mounted on a paint can with a person's hand engaged therein, in accordance with the present invention.

The outer surface 23*b* of the front portion 24 of the perimeter wall 23 is where the user rests his or her palm, while the tips of the user's fingers grasp the outer surface 23*b* of the back portion 25. As such, it is preferred that the entire base 20 be of a size adapted to fit within one's hand. In particular, it is preferred that the base 20 fit comfortably within the user's hand while the hand is in a cupped position, as depicted in FIG. 6. The outer surface 23*b* of the front portion 24 preferably has a curved shape while outer surface 23*b* of the back portion 25 is preferably provided with finger tip notches 28, as shown in the figures. This structure allows one to comfortably cup their hand there-around while simultaneously applying pressure on the front 24 with the palm of their hand and on the back 25 with their finger tips, to more firmly grip the device 10.

Figure 4:
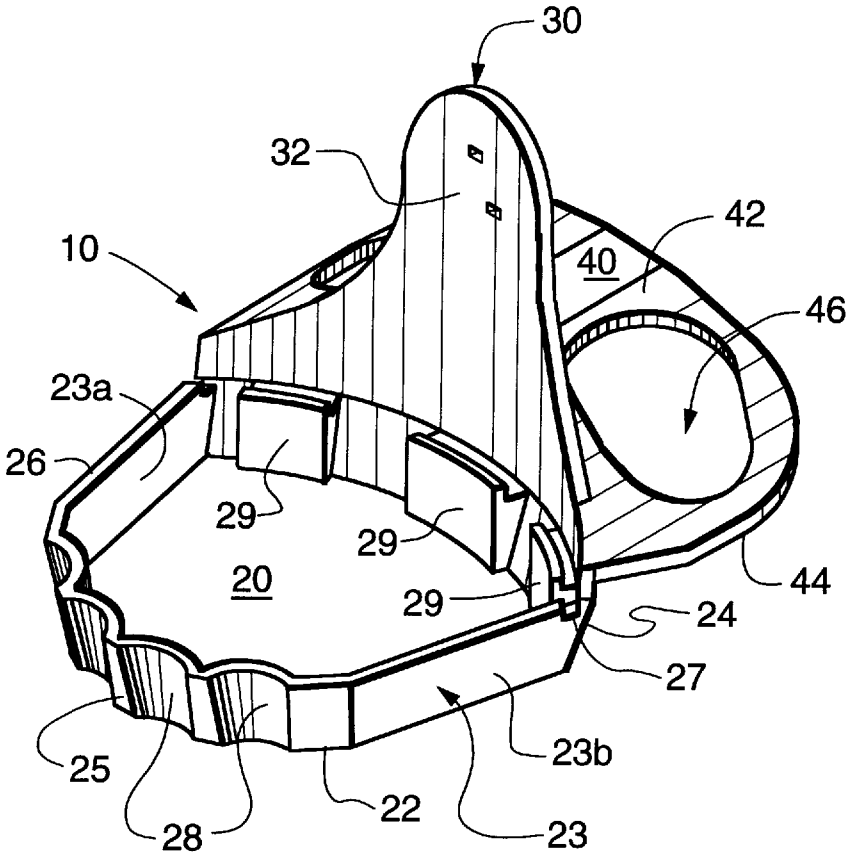
FIG. 4 is a perspective view of a preferred embodiment of a handle in accordance with the present invention.
Figure 5:
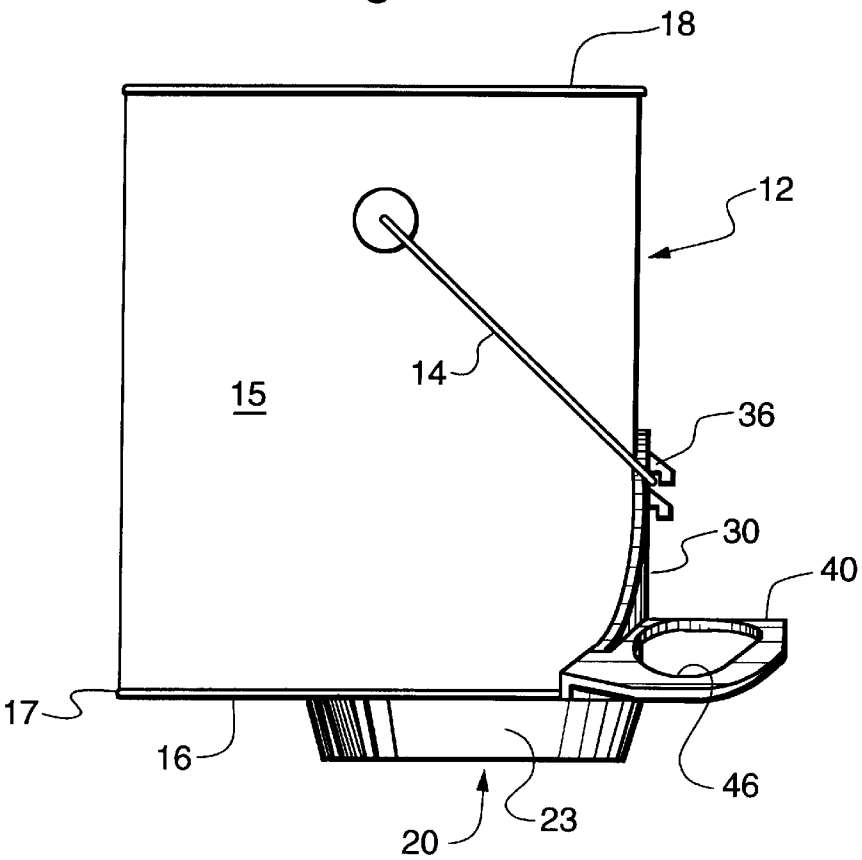
FIG. 5 is a perspective representation of a side view of a handle mounted on a pint can in accordance with the present invention.

The top surface 26 of perimeter wall 23 is preferably adapted to lie in the same plane as the bottom 16 of the paint can 12. The rim engaging groove 27 is adapted to receive the bottom rim 17 of the can 12 and is formed on a portion of the top surface 26 of the perimeter wall. In particular, the rim engaging groove 27 is formed along the top surface of the front portion 24 of wall 23 adjacent to side support 30 (as better shown in FIG. 3). It is critical that rim engaging groove 27 be sized to accept the bottom rim 17 of the can 12. In most cases, the bottom rim 17 of a paint can 12 is circular. Therefore, the groove 27 of the perimeter wall 23 should be formed in a corresponding arc of circle as shown in FIGS. 4–6. In a preferred embodiment, the outer surface 23*b* of the front portion 24 of the perimeter wall 23 is also shaped in an arc of circle which corresponds to the arc of circle of the bottom rim 17 of the can 12. Such a structure is also depicted in the figures. If for some reason the bottom rim 17 of a paint can 12 is shaped in a form other than circular, then groove 27 should be formed in a corresponding shape.

In a preferred embodiment shown in FIG. 4, groove 27 is not formed on the top surface 26 of the perimeter wall 23, but is instead formed on the top surface of three internal supports 29 which are attached to or extend from the inner surface 23*a* of the front portion 24 of the perimeter wall 23. The three supports 29 each have a groove 27 formed on their top surface and the supports 29 are preferably spaced equidistant from each other along an arc of circle corresponding to the arc of circle formed by the bottom rim 17 of the paint can 12. The number of, and spacing between, the supports 29, however, is not critical so long as the supports 29 can accept and adequately support the bottom rim 17 of the paint can 12.

Extending substantially vertically from the front 24 of the perimeter wall 23 adjacent to the groove 27 is a side support 30. Side support 30 comprises an inner surface 32 and an outer surface 34. The inner surface 32 faces groove 27 and is preferably adapted to hug the side wall 15 of the can 12. As such, it is preferred that the inner surface 32 be shaped in the form corresponding to the shape of the side wall 15 of the can 12.

The inner surface 32 of the side support 30 is designed to cooperate with groove 27 such that they simultaneously engage the bottom rim 17 and the side wall 15 of the can 12. An additional purpose of the side support 30 is to provide a place to attach the bail engaging hook 36. In this respect, the size and shape of the side support 30 must be adapted to allow the bail engaging hook 36 to be attached thereon at a position which can hook the bail 14 as described below. In a preferred embodiment (depicted in the figures), in order to reduce the weight of the device, the side support 30 is bell-shaped.

As just mentioned, disposed on the outer surface 34 of the side support 30 is a bail engaging hook 36. As shown in FIGS. 1 & 5, the hook 36 is positioned so as to be able to engage the bail 14 of the can 12. Hook 36 preferably extends in a direction away from the inner surface 32 of the side support. It is important that the hook be positioned on the side support 30 at a distance from the top 18 of the can 12 such that when the handle 10 is attached to the can 12, the bail 14 is tightly grasped by the hook 36. In a preferred embodiment, two hooks 37 are provided to accommodate bails 14 or cans 12 of different sizes. Indeed, one may provide as many hooks 36 as deemed necessary to accommodate all sized cans 12 and bails 14.

Extending substantially perpendicularly from the outer surface 34 of side support 30 is a hand abutment 40. The hand abutment 40 comprises an arced wall having an upper surface 42 and a lower surface 44. It is preferred that the hand abutment 40 be arced or curved as shown in the figures, so as to more comfortably rest on the user's hand.

Formed through the hand abutment 40 are preferably two thumb openings 46 & 48. The thumb openings 46, 48 are each sized to allow any user's thumb to fit comfortably therethrough. In particular, it is preferred that the left opening 46 be adapted to allow a user's left thumb to fit therethrough, and vice versa for the right opening 48. The openings 46, 48 provide a location for one to insert their thumb in order to more stably hold the handle 10 while the handle 10 is attached to the can 12. Although it is preferred that two openings be provided on the hand abutment 40, one can place as few or as many openings as one desires to improve comfort and/or reduce costs.

Any material which is structurally sound enough to support a paint can as described above, and which is resistant to solvents and thinners, can be used in the construction of the handle 10. It is preferred that a light, composite plastic such as polypropylene be used.

In operation, the bail 14 of the can 12 is allowed to drop off to the side of the can. The bail engaging hook 36 of the handle 10 is then hooked to the bail 14 of a can 12 with the inner surface 32 of the side support 30 facing the side wall 15 of the can. The base 20 of the handle is then slid under the bottom 16 of the can 12 such that the groove 27 engages the bottom rim 17 of the can 12. At this point, hook 36 is tightly grasping the bail 14, the bottom rim 17 is snugly fitted within groove 27, and the inner surface 32 of the side support 30 is hugging the side wall 15 of the can. Once in this position, the handle 12 is attached to the can in a stable fashion, and the device is ready for use.

To use the device, the user first slides his or her thumb through the appropriate thumb opening on the hand abutment 40. Once the thumb is in position, the palm is brought to rest against the outer surface 23*b* of the front portion 24 of the perimeter wall 23 while the remaining four fingers grasp the base 20 using finger notches 28. At this point, the user can hold and carry the can 10 upright, with one hand, in a firm and stable manner by grasping the base 20.

Those skilled in the art having the benefit of the teachings of the present invention as hereinabove set forth, can effect numerous modifications thereto. These modifications are to be construed as being encompassed within the scope of the present invention as set forth in the appended claims.

What is claimed is:

1. A detachable handle for use with a paint can having a bottom, a bottom rim, a side wall and a bail, the detachable handle comprising:

a base along a first direction, a side support extending substantially perpendicular from the base in a second direction, the side support having an inner surface and an outer surface;

a rim engaging groove on the base adjacent the support;

a bail engaging hook mounted on the outer surface of the side support; and a hand abutment extending from said support, said hand abutment having a bottom surface and a substantially parallel top surface, and extending along the first direction, and a thumb opening in said abutment for permitting a user's thumb to extend from the bottom surface to the top surface.

2. The handle of claim 1 wherein the base comprises a bottom, having a perimeter and a perimeter wall extending substantially perpendicular from the bottom along the perimeter, said perimeter wall having a back portion, a front portion, an inner surface, an outer surface and a top surface.

3. The handle of claim 2 wherein the side support is connected to the base along the front portion of the perimeter wall.

4. The handle of claim 2 wherein the rim engaging groove is formed on the top surface of the perimeter wall along the front portion.

5. The handle of claim 2 further comprising at least one internal support, disposed on the inner surface of the front portion of the perimeter wall, wherein the rim engaging groove is formed on the internal support.

6. The handle of claim 5 further comprising three internal supports.

7. The handle of claim 1 wherein the hand abutment has two thumb openings.

8. The handle of claim 1 wherein the hand abutment extends substantially perpendicular to the side support.

9. The handle of claim 8 wherein the hand abutment comprises an arced wall.

10. The handle of claim 1 wherein the bail engaging hook extends in a direction opposite the inner surface of the side support.

11. The handle of claim 1 wherein the side support has two hooks disposed on the outer surface.

* * * * *